United States Patent [19]

Ee

[11] Patent Number: 4,794,852

[45] Date of Patent: Jan. 3, 1989

[54] INLET DEVICE

[75] Inventor: Dirk V. Ee, Saskatchewan, Canada

[73] Assignee: Del Air Systems Ltd., Humboldt, Canada

[21] Appl. No.: 148,887

[22] Filed: Jan. 27, 1988

[51] Int. Cl.[4] ..... F24F 13/18

[52] U.S. Cl. ..... 98/118; 98/37

[58] Field of Search ..... 98/1.5, 33.1, 37, 95, 98/99.6, 118, 119

[56] References Cited

U.S. PATENT DOCUMENTS

| | | | |
|---|---|---|---|
| 217,215 | 7/1879 | Hayes | 98/118 |
| 1,975,316 | 10/1934 | Ferris | 98/119 |
| 2,212,468 | 8/1940 | Ferris | 98/37 |
| 2,706,443 | 4/1955 | Meador | 98/37 X |
| 2,800,853 | 7/1957 | Spear | 98/119 X |
| 3,057,288 | 10/1962 | Papsdorf | 98/119 |
| 4,022,117 | 5/1977 | Mallian | 98/119 X |

FOREIGN PATENT DOCUMENTS

| | | | |
|---|---|---|---|
| 78268 | 3/1894 | Fed. Rep. of Germany | 98/118 |
| 7142 | 4/1896 | Sweden | 98/118 |
| 34837 | 3/1910 | Sweden | 98/118 |

*Primary Examiner*—Harold Joyce

*Attorney, Agent, or Firm*—Adrian D. Battison; Stanley G. Ade; Murray E. Thrift

[57] ABSTRACT

An inlet device for the wall of a building for example an animal barn comprises a simple moulded rectangular body through which the air can pass having an open mouth at one end and an inlet surface in a lower downwardly facing surface on the outer side of the wall. A door on a front face of the housing is hinged along a flange on the lower side of the housing as to hang down in the open condition. The door includes a foamed projection which can seal with a recess surrounding the open mouth of the housing. Inside the housing is provided a foamed plate-like shutter which is spring biassed into a closed position against flanges along the sides of the housing. The base of the shutter is freely mounted in a v-shaped area defined at a step above the lower surface of the housing to prevent freezing.

18 Claims, 2 Drawing Sheets

INLET DEVICE

BACKGROUND OF THE INVENTION

This invention relates to an air inlet device of a type for mounting in an opening in the wall of a building for example, in a barn of a type for housing animal husbandry.

The control of air quality within an animal husbandry barn is of extreme importance since the animals produce high levels of humidity and toxic fumes which must be controlled within the barn. In addition, in geographical locations where there are very cold outside temperatures during winter, it is also necessary to ensure that the above fumes and humidity is controlled without excessive loss of heat from the building to reduce to a minimum the application of additional heat to keep the animals at a required temperature.

In many cases air flow into the barn is controlled by a number of inlets which open automatically when the air pressure within the barn drops below a certain amount so as to allow air to flow into the barn through the inlet to replace air pumped out of the barn, for example, by heat exchangers or by exhaust fans. The inlet should of course be able to close to halt the air flow when no additional air is required in the barn so as to control the cold inlet air to the minimum required to keep the barn pressure at the normal operating level.

Generally in a device of this type it is arranged that it can be simply mounted in an opening cut in the wall of the building and attached to the wall to hold the inlet in place. Devices manufactured from a plastics material are much to be preferred in view of the reduced corrosion. In addition, the presentation of the outside inlet opening in an under surface of the device reduces the amount of wind effect on the inlet and also prevents the collection of rain or snow within the inlet.

It is one object of the present invention to provide a particularly advantageous design of inlet of the above general type which satisfies the above requirements and provides an effective device at low manufacturing cost.

According to the invention there is provided an air inlet for mounting in a wall of a building comprising an integrally moulded plastics body defining a sleeve portion of rectangular cross-section having an upper wall, a lower wall and two side walls, one end of the sleeve portion defining a planar open mouth lying in a plane at right angle to the length of the sleeve portion, a hooded inlet portion connected to an opposed end of the sleeve portion and having an upper cover surface extending through an angle of the order of 90 degrees, two sides and a lower open inlet surface arranged at right angles to said open mouth and covered by said sides and said cover surface, an abutment surface at said one end of the sleeve portion extending outwardly therefrom for engaging an inner surface of the wall with the sleeve portion extending through an opening in the wall, a door support flange extending outwardly from said sleeve portion at said open mouth, a door hingedly mounted on said door support flange for movement between a closed position closing said open mouth and an open position exposing said open mouth for passage of air through said inlet, air leakage sealing means coacting between said door and said sleeve portion at said open mouth in said closed position of the door, a pivotal shutter mounted within said sleeve portion comprising a planar rigid rectangular sheet member having a lower edge arranged adjacent one side of said inlet surface and inclined upwardly and longitudinally of said sleeve portion to an upper edge thereof adjacent said open mouth, means mounting said shutter for pivotal movement about said lower edge from the closed position extending across said sleeve portion to prevent the flow of air through said sleeve portion to an open position in which said shutter lies substantially flat along said lower wall of the sleeve portion, and spring means applying a biassing force to said shutter to maintain it in said closed position, each of said upper, lower and side walls of said sleeve portion having at said open mouth integrally moulded therewith a first outwardly extending flange wall and a recess wall generally parallel to the respective wall of the sleeve portion to define a recess surrounding the open mouth, an outer surface of said flange wall defining said abutment surface, an inner surface of said door having extending therefrom a sealing member arrangement to cooperate with an inner surface of said recess wall to define said air leakage ceiling means.

According to a second aspect of the invention an air inlet for mounting in a wall of a building comprising an integrally moulded plastics body defining a sleeve portion of rectangular cross-section having an upper wall, a lower wall and two side walls, one end of the sleeve portion defining a planar open mouth lying in a plane at right angle to the length of the sleeve portion, a hooded inlet portion connected to an opposed end of the sleeve portion and having an upper cover surface extending through an angle of the order of 90 degrees, two sides and a lower open inlet surface arranged at right angles to said open mouth and covered by said sides and said cover surface, an abutment surface at said one end of the sleeve portion extending outwardly therefrom for engaging an inner surface of the wall with the sleeve portion extending through an opening in the wall, a door support flange extending outwardly from said sleeve portion at said open mouth, a door hingedly mounted on said door support flange for movement between a closed position closing said open mouth and an open position exposing said open mouth for passage of air through said inlet, air leakage sealing means coacting between said door and said sleeve portion at said open mouth in said closed position of the door, a pivotal shutter mounted within said sleeve portion comprising a planar rigid rectangular sheet member having a lower edge arranged adjacent one side of said inlet surface and inclined upwardly and longitudinally of said sleeve portion to an upper edge thereof adjacent said open mouth, means mounting said shutter for pivotal movement about said lower edge from the closed position extending across said sleeve portion to prevent the flow of air through said sleeve portion to an open position in which said shutter lies substantially flat along said lower wall of the sleeve portion, and spring means applying a biassing force to said shutter to maintain it in said closed position, said shutter being loosely pivotally mounted within said sleeve portion, said sleeve portion defining a support member for said lower edge of said shutter at a position arranged above the lower wall of said sleeve portion and defining a v-shaped area within which said lower edge is constrained for free pivotal movement.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 4:
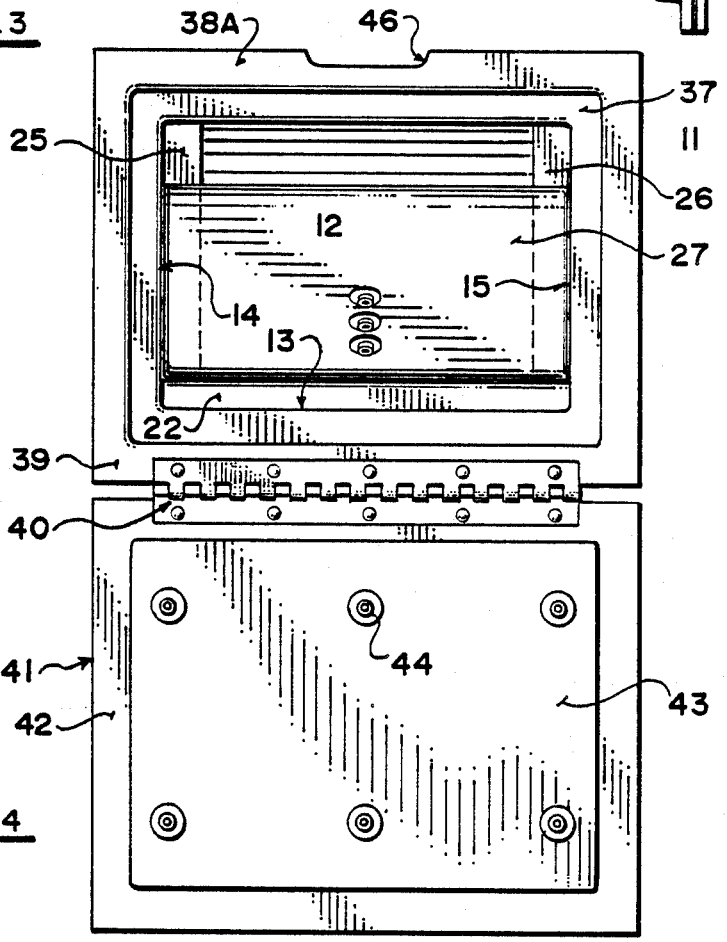
FIG. 4 is a front elevational view of the device of FIG. 1 showing the door in the opened portion thereof.

The device comprises an integrally moulded housing 10 which includes a sleeve portion 11 having a rectangular cross-section as shown best in FIG. 4 defined by an upper wall 12, a lower wall 13, and side walls 14 and 15. In one example of the device, the width of the sleeve portionis of the order of 14 inches and the height of the portion is of the order of 10 inches which is defined to fit a suitable opening indicated at 16 in FIG. 1.

Figure 1:
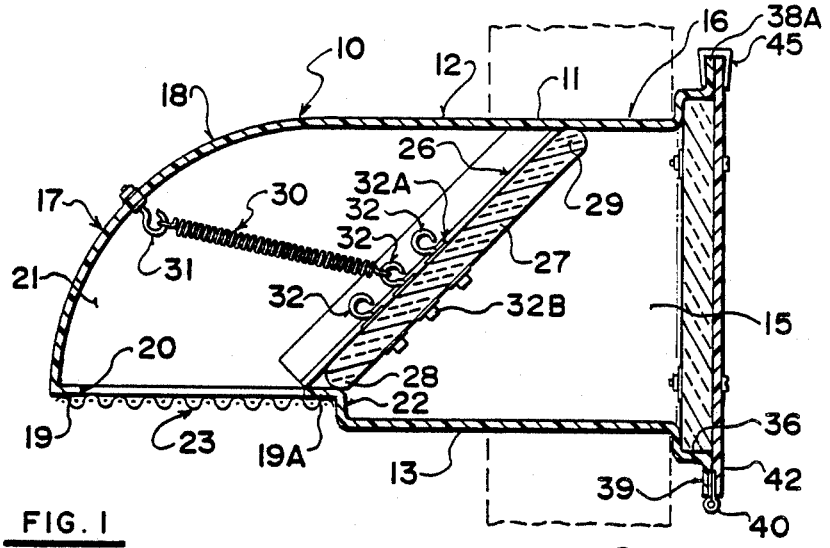
FIG. 1 is a longitudinal cross-sectional view of an air inlet device according to the invention showing the outer door and internal pivotal shutter in the closed positions.

At a rear edge of the sleeve portion 11 is mounted an inlet portion 17 which is defined by a curved upper cover wall 18 which is smoothly curved about a single axis over an angle of the order of 90 degrees so as to connect the upper wall 12 of the sleeve portion to an underside opening wall 19 within which is defined an inlet opening 20 of the inlet device. Sides of the cover portion 17 one of which is shown in FIG. 1 and indicated at 21 are contiguous with the sides 14 and 15 of the sleeve portion to form flat planar sides of the device.

The lower wall 19 within which the opening 20 is defined is positioned at small height above the lower wall 13 of the sleeve portion thus defining a step 22 at the interconnection between the lower wall 13 and the opening wall 19.

Figure 3:
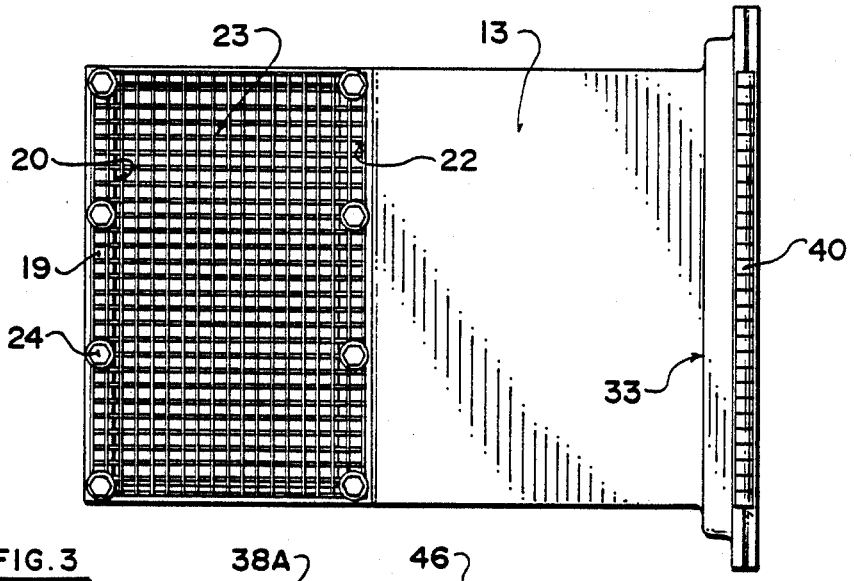
FIG. 3 is an underside view of the device of FIG. 1.

A screen 23 of a suitable metal grid is screwed or otherwise attached over the rectangular opening 20 as best shown in FIG. 3 with the screws holding the screen in place being indicated at 24.

Along each side wall 14 and 15 of the sleeve portion is mounted a flange shown respectably at 25 and 26. Each of the flanges is constructed from a right angled piece of extruded plastics material so that one side of the angle can be attached to the respective side wall of the sleeve portion with the other side of the angle projected outwardly to define the flange which is inclined upwardly from the area of the step 22 toward the front of the inlet. A lower edge of the flange is positioned slightly rearwardly of the step 22 so that a portion indicated at 19A of the lower wall defines a converging v-shaped area with the lower most portion of the flange indicated at 26. This v-shaped area is of course defined only at the sides of the device but provides a seat for a pivotal shutter 27 in the form of a flat sheet of a foamed material. A lower edge of the foamed material is indicated at 28 and is smoothly curved so that it sits within the v-shaped area defined by the wall portion 19A and the flanges thus allowing pivotal movement of the shutter about the v-shaped area by rolling movement of the curved lower edge 28. An upper edge indicated at 29 of the shutter is also smoothly curved for aesthetic reasons.

The size of the shutter is chosen so that in a closed position thereof it lies against the outer surfaces of the flanges and extends from the v-shaped area at the lower edge to a position at the upper edge which is just in contact with the underside of the upper wall 11 at its interconnection with the flanges.

In one example, the shutter can be formed from a polystyrene foamed material which is light in weight, of an insulating nature and slightly resilient to as to provide an effective sealing between the outer surface of the sheet and the various surfaces which it contacts in the closed position.

The polystyrene sheet 27 is biased into the closed position by spring 30 which has one end attached to a hook 31 mounted on the curved cover wall 18 and opposed end of the spring is attached to one of plurality of hooks 32 on a rear surface of the shutter. The plurality of hooks 32 are arranged relative to the position of the hook 31 and the length of the spring 30 so as to provide different biassing forces pulling the shutter into the closed position.

In operation, the shutter opens automatically on generation of an air pressure difference between the outer side of the building on the upper or outer side of the shutter and the inside of the building on the lower or inner side of the shutter with the pressure difference being sufficient to overcome the spring bias provided by the spring 30. Thus the various hooks 32 allow an adjustment of the amount of pressure difference which is necessary to open the shutter. It will of course also be appreciated that the shutter opens to a differing amount depending upon the air pressure difference and thus the amount of air flow which takes place when the shutter opens. Each of the hooks 32 includes a washer 32A and a bolt 32B so that it can be bolted through the polystyrene foam without damage to the foam and without the danger of the hook being pulled out of the foam under the pressure of the spring 30.

Figure 2:
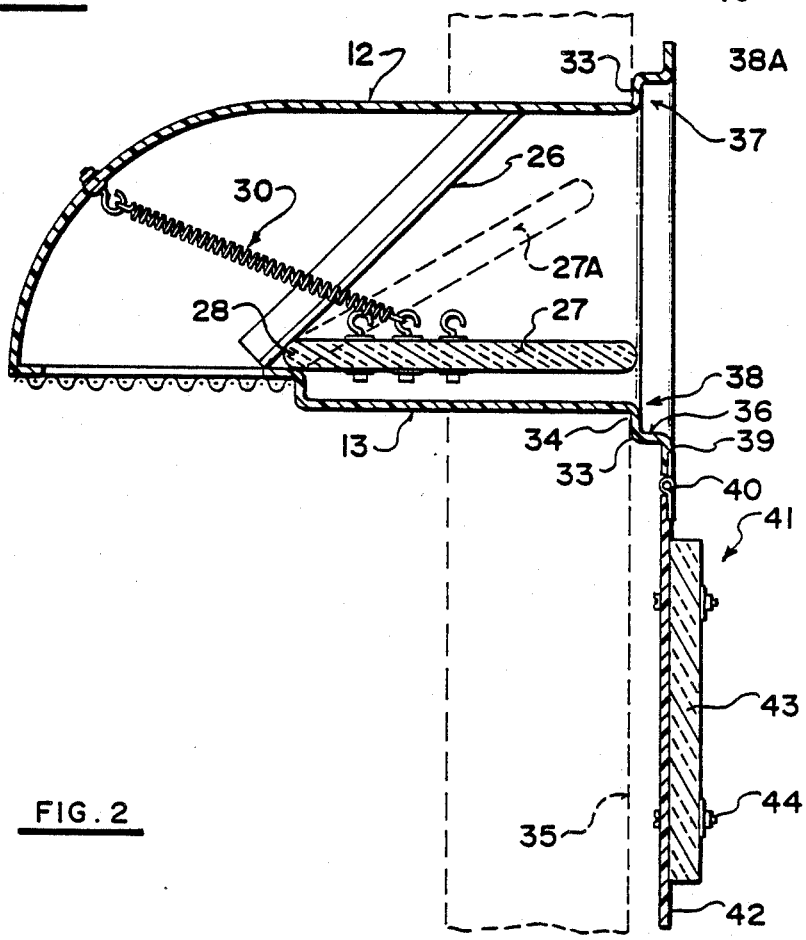
FIG. 2 is the same longitudinal cross-sectional view as that of FIG. 1 showing the outer door and the pivotal shutter in the open positions thereof.

The open position of the shutter is shown in FIG. 2 in which the shutter 27 lies effectively flat against the lower surface 13 of the sleeve portion. An intermediate position of the shutter is indicated at 27A. The shutter is fully opened when the amount of air flow is sufficient to push it into the fully open position against the bias of the spring 30.

The positioning of the lower edge 28 of the shutter on top of the step 22 ensures that the lower edge is maintained away from any collecting moisture so as to inhibit or prevent the shutter becoming frozen in place after a lengthy period in the closed position in very cold weather.

At a front end of the sleeve portion 11, each of the upper, lower and side walls of the sleeve portion include an outwardly turned flange wall 33 which lies generally at right angles to the length of the sleeve portion so as to define an abutment surface 34 which in use engages an inner surface 35 of the wall. Thus the device is located in the wall by the abutment surface 34 by which the device can be screwed to the wall as required. The abutment surface is thus formed integrally as part of the housing of the device without necessity for additional pieces. From the outer edge of the flange wall 33 extends a recess wall 36 which lies parallel to the respective one of the upper, lower and side walls of the sleeve portion to define a recess 37 surrounding the open mouth indicated at 38 of the sleeve portion.

From the outer edge of the recess wall 36 is provided an outwardly extending terminating flange 38 which surrounds the whole of the device including the lower wall 13 and the upper wall 12. At the lower wall 13, the surrounding flange specifically indicated at 39 provides a door support flange to which is attached a hinge 40. An opposing part of the hinge 40 carries a door 41 formed from a flat sheet 42 of a plastics material to which is attached an upstanding foam sheet 43 by bolts 44.

In the open position shown in FIGS. 2 and 4, the door simply hangs downwardly from the door flange 39 leaving the inlet device in an open condition so that air can flow through the inlet device as previously described. In the position shown in FIGS. 1 and 3, the door is in a closed condition. The foam sheet 43 is of a size so that in the closed condition it is a press fit against the inner surface of the recess wall 36 to provide a sealing effect between the door and the housing. As the outer surface of the foam sheet 43 is free from projections or recesses and the inner surface of the recess wall 36 is similarly free from projections and recesses, an effective surrounding seal can be obtained simply by the press fit of the door against the outer face of the housing.

The door is retained in the latched or closed condition simply by a channel member 45 which is slipped over the upper edge of the sheet 42 of the door and over the upper flange 38A to clamp those pieces together and to retain the door in the closed position. A shallow recess 46 is provided in the upper flange 38A to allow the fingers of the user to grasp the door when the channel member 45 is removed.

The device therefore basically comprises a simple, single rotationally moulded housing of the shape defined above together with the separate planar sheet forming the door and the additional foamed pieces defining the door, sealing and insulation member and the shutter panel. The device can therefore be manufactured simply with little post-moulding assembly work and accordingly is inexpensive to manufacture. The position and mounting of the shutter provides an effective control of the air flow with an effective sealing technique despite the simplicity of the shutter panel.

The use of the additional recess surrounding the open mouth of the sleeve part and the mounting of the sleeve shutter enables the device to maximize the air flow through the opening in the wall.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An air inlet for mounting in a wall of a building comprising an integrally moulded plastics body defining a sleeve portion of rectangular cross-section having an upper wall, a lower wall and two side walls, one end of the sleeve portion defining a planar open mouth lying in a plane at right angle to the length of the sleeve portion, a hooded inlet portion connected to an opposed end of the sleeve portion and having an upper cover surface extending through an angle of the order of 90 degrees, two sides and a lower open inlet surface arranged at right angles to said open mouth and covered by said sides and said cover surface, an abutment surface at said one end of the sleeve portion extending outwardly therefrom for engaging an inner surface of the wall with the sleeve portion extending through an opening in the wall, a door support flange extending outwardly from said sleeve portion at said open mouth, a door hingedly mounted on said door support flange for movement between a closed position closing said open mouth and an open position exposing said open mouth for passage of air through said inlet, air leakage sealing means coacting between said door and said sleeve portion at said open mouth in said closed position of the door, a pivotal shutter mounted within said sleeve portion comprising a planar rigid rectangular sheet member having a lower edge arranged adjacent one side of said inlet surface and inclined upwardly and longitudinally of said sleeve portion to an upper edge thereof adjacent said open mouth, means mounting said shutter for pivotal movement about said lower edge from the closed position extending across said sleeve portion to prevent the flow of air through said sleeve portion to an open position in which said shutter lies substantially flat along said lower wall of the sleeve portion, and spring means applying a biassing force to said shutter to maintain it in said closed position, each of said upper, lower and side walls of said sleeve portion having at said open mouth integrally moulded therewith a first outwardly extending flange wall and a recess wall generally parallel to the respective wall of the sleeve portion to define a recess surrounding the open mouth, an outer surface of said flange wall defining said abutment surface, an inner surface of said door having extending therefrom a sealing member arrangement to cooperate with an inner surface of said recess wall to define said air leakage sealing means.

2. The invention according to claim 1 wherein at least the recess wall opposite to said door flange has thereon an outwardly extending flange portion arrange to lie along side an edge of the door in a closed position thereof so the flange portion and the edge of the door can be clamped together by a channel shape member placed thereover.

3. The invention according to claim 2 wherein said flange portion extends fully around the sleeve portion.

4. The invention according to claim 1 wherein said sealing member of said door comprises a sheet of an insulating foam material.

5. The invention according to claim 1 wherein said spring means comprises a tension spring which is jointed to said cover surface and to an outer side of said pivotal shutter.

6. The invention according to claim 5 wherein said shutter includes a plurality of attachment members for attachment to said spring so as to adjust the biassing force.

7. The invention according to claim 1 wherein said door support flange is arranged at said lower wall of said sleeve portion such that when in the open position the door hangs downwardly from said lower edge.

8. The invention according to claim 1 including a screen covering said open lower inlet surface.

9. The invention according to claim 1 wherein said shutter is loosely mounted in said sleeve portion and wherein said sleeve portion defines a v-shaped area for confining said lower edge of said shutter with said spring means rearranged to bias said lower edge into said v-shaped area.

10. An air inlet for mounting in a wall of a building comprising an integrally moulded plastics body defining a sleeve portion of rectangular cross-section having an upper wall, a lower wall and two side walls, one end of the sleeve portion defining a planar open mouth lying in a plane at right angle to the length of the sleeve portion, a hooded inlet portion connected to an opposed end of the sleeve portion and having an upper cover surface extending through an angle of the order of 90 degrees, two sides and a lower open inlet surface arranged at right angles to said open mouth and covered by said sides and said cover surface, an abutment surface at said one end of the sleeve portion extending outwardly therefrom for engaging an inner surface of the wall with the sleeve portion extending through an opening in the wall, a door support flange extending outwardly from said sleeve portion at said open mouth, a door hingedly mounted on said door support flange for movement between a closed position closing said open mouth and an open position exposing said open mouth for passage of air through said inlet, air leakage sealing means coacting between said door and said sleeve portion at said open mouth in said close position of the door, a pivotal shutter mounted within said sleeve portion comprising a planar rigid rectangular sheet member having a lower edge arranged adjacent one side of said inlet surface and inclined upwardly and longitudinally of said sleeve portion to an upper edge thereof adjacent said open mouth, means mounting said shutter for pivotal movement about said lower edge from the closed position extending across said sleeve portion to prevent the flow of air through said sleeve portion to an open position in which said shutter lies substantially flat along said lower wall of the sleeve portion, and spring means applying a biassing force to said shutter to maintain it in said closed position, said shutter being loosely pivotally mounted within said sleeve portion, said sleeve portion defining a support member for said lower edge of said shutter at a position arranged above the lower wall of said sleeve portion and defining a v-shaped area within which said lower edge is constrained for free pivotal movement.

11. The invention according to claim 10 wherein each of said side walls of said sleeve portion includes a flange extending inwardly therefrom and inclined from said support portion to said upper wall of said sleeve portion so as to define a base against which said shutter rests in the closed position thereof.

12. The invention according to claim 10 wherein said support portion comprises a substantially horizontal surface stepped upwardly from said lower wall of said sleeve portion, said open lower inlet surface being defined in said substantially horizontal surface.

13. The invention according to claim 10 wherein said spring means comprises a tension spring which is jointed to said cover surface and to an outer side of said pivotal shutter.

14. The invention according to claim 13 wherein said shutter includes a plurality of attachment members for attachment to said spring so as to adjust the biassing force.

15. The invention according claim 10 wherein said door comprises a flat sheet of plastics material having attached thereto on an inner surface thereof a sheet of an insulating foam material of a size to project into said sleeve portion.

16. The invention according to claim 10 wherein said door support flange is arranged at said lower wall of said sleeve portion such that when in the open position the door hangs downwardly from said lower edge.

17. The invention according to claim 10 including a screen covering said open lower inlet surface.

18. The invention according to claim 10 wherein said shutter is loosely mounted in said sleeve portion and wherein said sleeve portion defines a v-shaped area for confining said lower edge of said shutter with said spring means rearranged to bias said lower edge into said v-shaped area.

* * * * *